United States Patent [19]

Hosono et al.

[11] 4,337,724

[45] Jul. 6, 1982

[54] DEVELOPING DEVICE

[75] Inventors: Nagao Hosono, Chofu; Junichiro Kanbe, Tokyo; Kozo Arao; Nobuyuki Miyake, both of Yokohama, all of Japan

[73] Assignee: Canon Kabushiki Kaisha, Tokyo, Japan

[21] Appl. No.: 118,927

[22] Filed: Feb. 6, 1980

[30] Foreign Application Priority Data

Feb. 15, 1979 [JP] Japan ..... 54-17739

[51] Int. Cl.[3] ..... G03G 15/09

[52] U.S. Cl. ..... 118/652; 118/657; 118/658; 355/3 DD

[58] Field of Search ..... 118/652, 653, 657, 658; 355/3 DD; 430/125

[56] References Cited

U.S. PATENT DOCUMENTS 2,839,400 6/1958 Moncrieff-Yeates ..... 430/103
3,232,190 2/1966 Willmott ..... 355/3 R
4,089,297 5/1978 Morita et al. ..... 355/3 DD X
4,100,884 7/1978 Mochizuki et al. ..... 118/658 X
4,126,100 11/1978 Nishihama et al. ..... 118/658

*Primary Examiner*—Evan K. Lawrence
*Attorney, Agent, or Firm*—Fitzpatrick, Cella, Harper & Scinto

[57] ABSTRACT

A device in which triboelectric charge is imparted to developer and the developer is provided to a latent image includes a developer holding member disposed with a minute gap with respect to a latent image bearing member, a doctor blade for controlling the thickness of a developer layer on the developer holding member, a developer supply, a detachable scatter preventing cover to prevent scattering of developer, the cover being positioned upstream of the developer supply and downstream of a developing station, and a member disposed on said cover for removing the developer remaining on the developer holding member, whereby development may be effected with fresh developer supplied for each cycle of development.

11 Claims, 6 Drawing Figures

DEVELOPING DEVICE

BACKGROUND OF THE INVENTION

1. Field of the Invention

This invention generally relates to a developing device. More particularly, it relates to a developing device in which a uniform thin layer of one-component developer is formed on developer holding means and this layer is opposed to a latent image bearing member to develop the same.

2. Description of the Prior Art

For the developing devices using one-component developer, various methods are known or have been proposed.

Among these, the jumping developing method is known as a unique method. This method comprises applying developer as a thin layer onto developer holding means, thereafter opposing an electrostatic latent image surface to the surface of the thin layer of developer with a small gap interposed therebetween, and then causing the developer to jump from the developer holding means to the electrostatic latent image surface by the electrostatic attraction thereof to thereby effect development (see U.S. Pat. Nos. 2,839,400 and 3,232,190). According to this method, the developer is not only not attracted to the non-image bearing portion having no latent image potential but also does not contact the non-image bearing portion and therefore, good development free of fog can be accomplished. Further, where use is made of one-component developer using no carrier particle, there are also obtained good effects that the mixture ratio of the developer does not fluctuate and that there is no deterioration of carrier particles.

Also, the Applicant has proposed, as developing methods different from this jumping developing method, entirely novel developing methods as disclosed in U.S. Patent Applications Ser. No. 938,101, filed Aug. 30, 1978, abandoned; Ser. No. 938,494, filed Aug. 31, 1978, abandoned; Ser. No. 058,434, filed July 18, 1979, abandoned; and Ser. No. 058,435, filed July 18, 1979, U.S. Pat. No. 4,292,387.

The former two developing methods comprise disposing one-component magnetic developer, developer holding means (non-magnetic) and magnetic field generating means in the named order, forming a uniform thin layer of developer on the developer holding means by the magnetic force of the magnetic field generating means, and opposing the surface of the thin layer of developer to the electrostatic latent image forming surface with a minute gap interposed therebetween so that the former surface does not contact the latter surface. The developer opposed to the image bearing portion is extended by the electrostatic attraction thereof to thereby effect development. These methods can also obtain developed images free of fog because development is effected without the developer contacting the non-image bearing portion.

The latter two methods comprise disposing one-component magnetic developer, developer holding means (non-magnetic) and magnetic field generating means in the named order, forming a uniform thin layer of developer on the developer holding means by the magnetic force of the magnetic field generating means, and opposing the surface of the thin layer of developer to the electrostatic latent image forming surface with a minute gap interposed therebetween so that the former surface does not contact the latter surface. As a developing bias voltage, an AC bias voltage is applied to the same and further, the gap between the electrostatic latent image surface and the developer holding means is varied with time to thereby effect development. By these latter methods, in the initial stage of the development, the developer is caused to arrive at the non-image bearing portion of the electrostatic latent image as well to thereby effect the development of the half-tone portion and the developer is caused to arrive only at the image bearing portion with time to thereby effect the development of such portion. By this, there is obtained the effect of development which is excellent in half-tone reproducibility as compared with the former methods and moreover is free of fog.

According to such developing methods in which development is effected with the thin layer of one-component developer disposed in opposed relationship with the latent image surface, there are obtained very excellent effects in respect of developing performance, image reproducibility, life of developer, etc. as compared with the conventional methods. However, even these developing methods may in some cases encounter the following problems when actually put into practice.

(1) By the developing action, the history of development is left on the layer of developer on the developer holding means to cause a ghost image to be developed during the next cycle of development.

In the aforementioned developing methods, the developer layer formed on the developer holding means is a very thin layer. Therefore, once this developer layer is used for development, a great difference in thickness of the developer layer is created between the portion thereof corresponding to the image bearing portion and the portion thereof corresponding to the non-image bearing portion. Such thickness history of the developer layer is intactly left even if fresh developer is supplied after the developer layer has been used for development, to greatly affect the next cycle of development and cause a disadvantage that the so-called ghost which is a negative pattern of the previously developed image is created in the next cycle of development. This is considered to be attributable to the inability to sufficiently replenish the surface of the developer holding means from which the developer has been brought away with fresh developer in the developer supplying step thereafter (or to some difference in characteristic (especially, tribo property) between the developer remaining on the surface of the developer holding means and the developer newly supplied thereto).

(2) A thin layer of developer is formed on the surface of the developer holding means in a long time during which the developing action is carried out, to reduce the developing performance.

During the developing action, the developer always repeats contact with and separation from the surface of the developer holding means, so that the surface of the developer holding means is contaminated by the developer and a film layer of developer is liable to form thereon. This film layer consists of resin component of low molecular weight contained in the developer, or a control agent for providing the tribo property, or a layer of very minute powder which does not contribute to the development. In any case, if these components cover the surface of the developer holding means, the amount of charge of the developer becomes deficient particularly in the case of the developing methods utilizing the charge created by the friction between the developer and the developer holding means, thus reducing the developing density and/or aggravating the image reproducibility.

(3) In a long time during which the developing action is carried out, aggregation of the developer is created or the adhesive force between the developer and the surface of the developer holding means is enhanced to make difficult the formation of a layer having a uniform thickness and cause irregularity of development.

There is no problem when the developer applied onto the developer holding means contributes to development and separates from the surface of the developer holding means within a short time, but if developer which does not contribute to development because of its low developing density is left on the surface of the developer holding means for a long time, the aggregation force of the developer is enhanced or the adhesive force between the developer and the surface of the developer holding means is enhanced to form a partially thick layer of developer which may create irregularity of the developed image.

A developing device having a member for removing toner greater in thickness than at least the toner layer brought away to the electrostatic latent image provided within a toner supply hopper in order to remove the history of development and prevent the creation of the so-called ghost image is disclosed, for example, in U.S. Pat. No. 4,100,884.

However, the device disclosed in this U.S. Patent is not of the type in which all the developer on the surface of the developer holding means is once removed as far as possible and then fresh developer is supplied to the developer holding means to effect development and therefore, it still suffers from the problems as mentioned under items (2) and (3), especially the problem (2).

SUMMARY OF THE INVENTION

It is an object of the present invention to provide a novel developing device which solves all the above-noted problems and which is good in image reproducibility and ensures high fidelity of reproduction and permits a long service life of developer.

It is another object of the present invention to eliminate the disadvantage peculiar to the prior art that in a long time during which the developing action is carried out, a thin layer of developer is formed on the surface of the developer holding means to reduce the developing performance.

That is, the present invention solves all the above-mentioned problems by providing a developing device having endless developer holding means disposed with a minute gap with respect to a latent image bearing member, developer supply means for supplying developer to the surface of the developer holding means, control means for controlling the thickness of a developer layer on the developer holding means, and a developer removing plate disposed so as to be in contact with the surface of the developer holding means in order to remove the developer on the surface of the developer holding means at a position before developer is supplied after the developing action and to again impart the removed developer to the surface of the developer holding means, said developer removing plate having developer passage openings in the neighborhood of the portion thereof which is in contact with the surface of the developer holding means.

Other objects and features of the present invention will become apparent from the following detailed description of the invention taken in conjunction with the accompanying drawings.

DESCRIPTION OF THE PREFERRED EMBODIMENTS

Figure 1A:
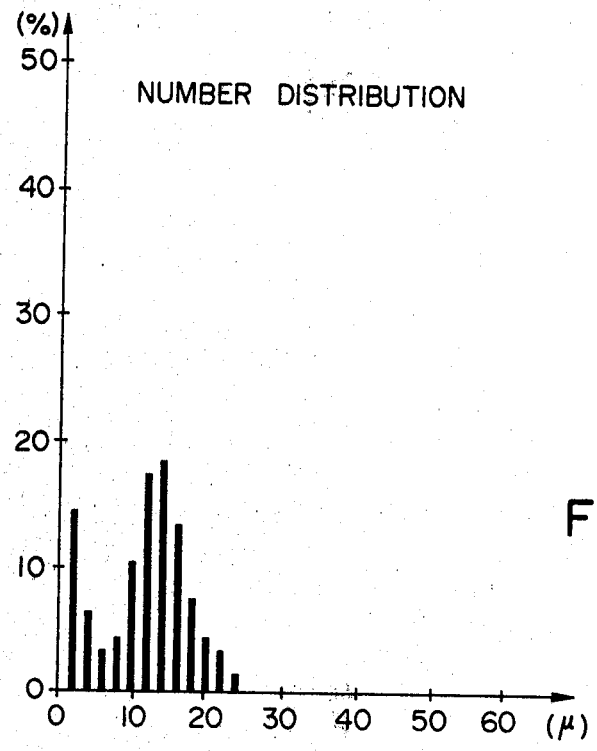
FIGS. 1A and 1B are graphs illustrating the particle number distribution for the particle diameter of developer particles and the weight distribution for the particle diameter, respectively.

Before specific embodiments of the present invention are described, the problem mentioned under item (2) above, namely, the contamination of the surface of the developer holding means by developer, will be further discussed to make clear the objects, operation and effect of the present invention.

As already described, in a long time during which the developing action is carried out a thin layer of developer may be formed on the surface of the developer holding means to reduce the developing performance.

During the developing action, the developer always repeats contact with and separation from the surface of the developer holding means and therefore, the surface of the developer holding means is contaminated by the developer and a film layer of developer is liable to form on that surface. This film layer consists of resin component of low molecular weight contained in the developer, or a control agent for providing friction, or a layer of very fine powder which does not contribute to development. More particularly, the following chemicals are generally often used as said control agent: Spyron Blue GNH (produced by Hodogaya Kagaku Co., Ltd., C.I. Solvent Blue 67), Zabbon Fast Black B (produced by BASF, C.I. 12195), Oil Blue #15 (produced by Yamamoto Kagaku Co., Ltd., C.I. 74350, C.I. Solvent Blue 25), McRolex Blue (produced by Baiel Co., C.I. Solvent Blue 97), Barifast Blue 2606 (produced by Orient Kagaku Co., Ltd., oil color), Oil Blue BOS (produced by Orient Kagaku Co., Ltd., oil color, C.I. 74350), Cassette Yellow G (produced by Nippon Kayaku Co., Ltd., C.I. 11855, C.I. Solvent Yellow 77), Eisenspyronred BEH (produced by Hodogaya Kagaku Co., Ltd., C.I. Solvent Red 83), Celitonred SF7874 (produced by BASF, dispersed dyes), and Cassette Yellow 963 (produced by Nippon Kayaku Co., Ltd., dispersed dyes). Also the main component of said fine powder which does not contribute to development but adheres to the surface of the developer holding means and forms a thin layer thereon is the resin component contained in the developer and more particularly, it includes the following: styrene and monopolymers of substitution products thereof such as polystyrene, poly-p-chlorostyrene and polyvinyl toluene, styrene copolymers such as styrene-p-chlorostyrene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-meta-acrylic acid methyl copolymer, styrene-meta-acrylic acid ethyl copolymer, styrene-meta-acrylic acid butyl copolymer, styrene-α-chlorometa-acrylic acid methyl copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer, polyvinyl chloride, polyvinyl acetate, polyethylene, polypropylene, silicone resin, polyester, polyurethane, polyamide, epoxy resin, polyvinyl butyral, rosin, denatured rosin, terpene resin, phenol resin, fatty hydrocarbon resin, aromatic petroleum resin, chlorinated paraffin and paraffin wax. Further, the material which adheres to the surface of the developer holding means may sometimes be the extraneously added fine particles of the so-called one-component developer which consists of toner particles and hydrophobic silica having a particle diameter smaller than that of said toner particles and extraneously added to said toner particles and which does not contain carrier particles greater in particle diameter than the toner particles.

Figure 1B:
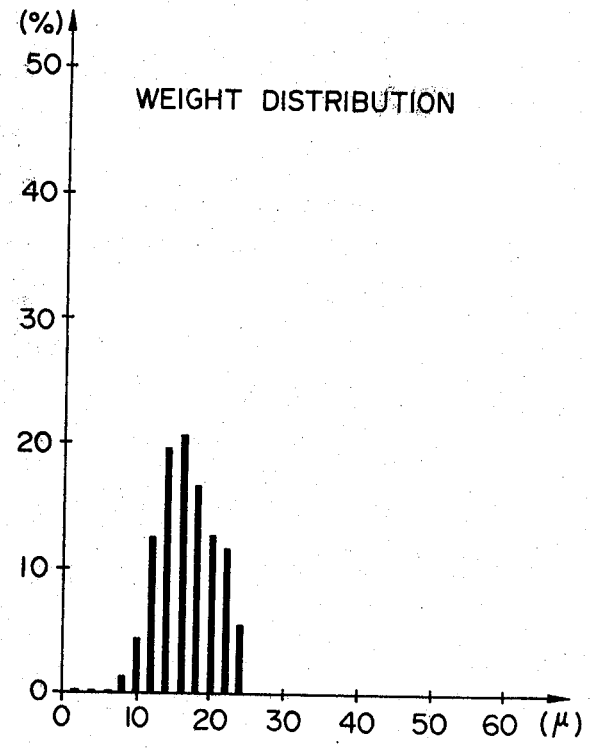

The fine particles containing much resin which do not contribute to development but adhere to the surface of the developer holding means to form a thin layer can be produced as by mixing resin with magnetic powder, charge control agent, carbon, etc., melting the mixture in a roll mill, cooling the same, roughly powdering the same by the use of a hammer mill, and then finely powdering the same into developer by the use of an ultrasonic jet powdering machine. The particle diameter distribution of the developer particles produced by the fine powdering contains considerably many fine particles. Therefore, rough particles are removed therefrom by the use of a classifier and these fine particles are also removed. However, fine particles having a low content of magnetic powder cannot yet be removed completely. An example of the particle diameter distribution of the developer particles after the classification is shown in FIGS. 1A and 1B. FIG. 1A shows the particle number distribution for the particle diameter, and FIG. 1B shows the weight distribution for the particle diameter. As shown in these Figures, considerably many fine particles which are light in weight (low in magnetic powder content) are still present even after the classification. These fine particles low in magnetic powder content or free of magnetic powder (they consist of only resin when observed through a microscope), once they electrostatically strongly adhere to the developer holding means, are not moved even by magnetic force because the magnetic force received by these particles is weak, so that a thin layer of these fine particles is formed on the surface of the developer holding means. When the surface of the developer holding means is thus covered with such fine particles, the frictional charge between the surface of the developer holding means and the developer is so affected that the developer cannot be friction-charged to a normal value and the amount of charge of the developer becomes deficient and in addition, where the application of the developer onto the developer holding means depends on the electrostatic force between the developer holding means and the developer, it becomes difficult for the developer to be applied onto the developer holding means and this leads to occurrence of the problem that the developing density is reduced or the image reproducibility is aggravated.

The present invention solves such a problem and embodiments thereof will hereinafter be described.

Figure 2A:
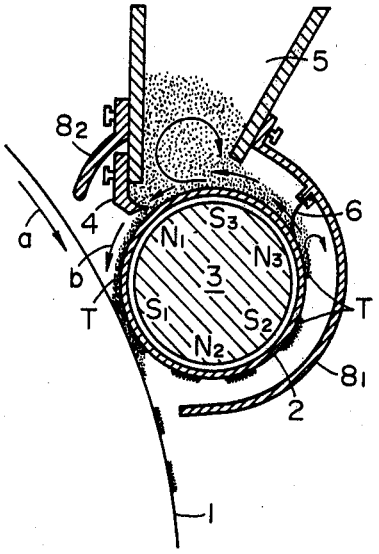
FIG. 2A is a cross-sectional view illustrating the construction of an embodiment of the developing device according to the present invention.
Figure 2B:
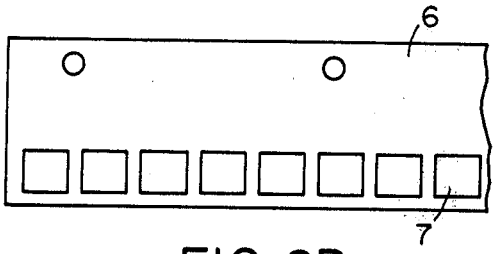
FIG. 2B is a front view of a developer removing plate.

FIGS. 2A and 2B show an embodiment of the present invention. Designated by 1 in FIG. 2 is an electrostatic latent image bearing member such as a photosensitive medium or an insulative medium on which an electrostatic latent image has been formed. It is movable in the direction of arrow a. Reference numeral 2 designates a non-magnetic developing sleeve (formed of, for example, stainless metal or brass) disposed with a minute gap with respect to the electrostatic latent image bearing member. The sleeve 2 is rotatable in the direction of arrow b. This minute gap is set to a gap greater than the thickness of the thin developer layer formed on the developing sleeve. Within the developing sleeve 2, a magnetic roll 3 magnetized as shown is fixedly provided. By the magnetic force of this magnetic roll 3, a layer of developer T is formed on the surface of the developing sleeve. The layer of developer has its thickness controlled by a doctor blade 4 (formed of iron, for example) disposed in proximity to the surface of the developing sleeve. The spacing between the tip end of this doctor blade 4 and the developing sleeve is set to 200 μm, for example. To make the thickness control of the developer layer more accurate and positive, a magnetic pole is disposed inside the developing sleeve at a portion thereof opposed to the tip end of the blade. The developer layer whose thickness has been controlled then reaches the developing position opposed to the electrostatic latent image bearing member 1 and effects development by any one of the aforementioned developing methods. After the termination of the development, the thickness of the developer layer has already been varied in accordance with the electrostatic latent image in such a manner that the portion thereof which has corresponded to the image bearing portion becomes thinner, the portion thereof which has corresponded to the non-image bearing portion maintains its original thickness and the portion thereof which has corresponded to the half-tone portion is changed to a thickness corresponding to the electrostatic latent image potential.

If, here, fresh developer is supplied onto the developer layer whose thickness has been varied after the development, as has conventionally be done, the developer supplied will be affected by the history of development and will not be able to form a developer layer having a uniform thickness even after the developer layer thickness control by the doctor blade 4, and even if a developer layer having a uniform thickness is obtained, faithful development will not be effected in the next cycle of development but the previously developed image will appear as a ghost. This is considered to be attributable to the difference in thickness of the developer layer before the fresh developer is supplied or to the difference in characteristic (tribo condition, etc.) between the developer of the developer layer once used for development and the newly supplied developer.

The present invention has been improved to overcome such disadvantage and in the embodiment of FIG. 2, the improvements are as follows. As already described, on the surface of the developing sleeve 2 after development, the thickness of the developer layer has been varied and the characteristic of the developer has also been varied and therefore, design is made such that before developer is supplied by a hopper 5, the developer on the surface of the developing sleeve is once scraped off by a developer removing plate 6 disposed in contact with the surface of the developing sleeve. That is, at a position upstream of the hopper 5 with respect to the direction of movement of the developer layer on the developing sleeve 2, the developer removing plate 6 is attached so as to be in contact with the surface of the developing sleeve. The angle of attachment thereof may preferably be an angle in the counter direction with respect to the direction of movement of the developer layer so that the developer may be scraped up, as shown. This removing plate may preferably be formed of phosphor bronze having a thickness of about 130 μm, for example. This removing plate 6 may preferably be provided with a developer scatter preventing cover $8_1$ extending in the upstream direction from the hopper 5. As shown in FIG. 2B, a number of apertures 7 are provided in the neighborhood of that portion of the removing plate which is in contact with the developing sleeve. The shape of these apertures may preferably be a square having sides of 10 mm each, for example.

In the above-described construction, the developing sleeve is rotated in the direction of arrow b, whereby the developer in the hopper is moved in the direction of arrow to form a layer of developer on the surface of the developing sleeve and is uniformly applied to the thickness of about 80 μm by the doctor blade 4. After the uniform application of the developer, the developer layer becomes opposed to the photosensitive medium 1 having an electrostatic latent image formed thereon, by further rotation of the developing sleeve, to thereby develop the latent image. After the termination of the development, the developer layer is scraped off from the surface of the developing sleeve by the developer removing plate 6 attached to the developer scatter preventing cover $8_1$ and the scraped-off developer passes through the apertures 7 provided in the neighborhood of that portion of the removing plate which is in contact with the developing sleeve, and again adheres to the surface of the developing sleeve.

In this case, where the fluidity of the magnetic developer T is high, the developer passes through the apertures 7 in the developer removing plate 6, but where the fluidity of the magnetic developer T is low, it becomes difficult for the developer to stably pass through these apertures 7. It is therefore necessary to generate a magnetic field which will attract the magnetic developer near the apertures 7 so that the developer may pass through the apertures in the removing plate.

That is, if a magnetic pole $N_3$ is disposed inside the developing sleeve 2 at a portion thereof opposed to these apertures 7 as shown in FIG. 2A, the magnetic developer scraped off by the developer removing plate 6 can easily pass through the apertures 7. The intensity of this magnetic pole $N_3$ may preferably be of the order of 450 to 850 gausses on the developing sleeve 2, and a greater intensity of the magnetic field has ensured greater stability with which the developer passes through the apertures 7. The developer scraping action of the developer removing plate 6 on the developing sleeve and the passage of the developer through the apertures in the removing plate 6 have been carried out satisfactorily without the developer accumulating on the tip end of the removing plate 6 even if the developing sleeve have been continuously rotated. Members $8_1$ and $8_2$ provided upstream and downstream of the hopper are developer scatter preventing covers.

By so providing the developer removing plate before developer is newly supplied after the termination of the development, it is possible to make the surface of the developing sleeve always clean and then effect the application of developer and this leads to the ability to maintain a stable developing performance without the fusion of the developer onto the surface of the developing sleeve.

Figure 3:
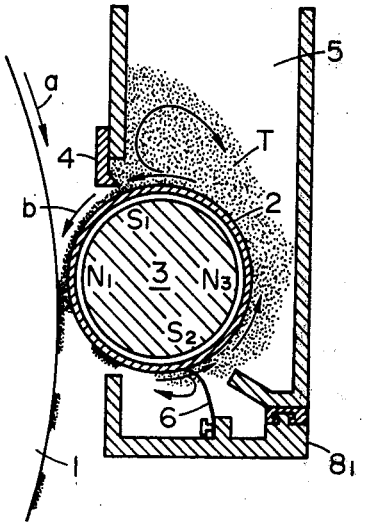
FIGS. 3 and 4 are cross-sectional views showing further embodiments of the present invention.

FIG. 3 shows another embodiment of the present invention. This embodiment is generally identical in construction to the embodiment of FIG. 2A, with the exception that a developer removing plate 6 is provided below the developing sleeve. In this case, to prevent the scraped-off developer from falling downwardly, a magnetic pole $S_2$ is disposed inside the developing sleeve at a portion thereof opposed to the apertures provided in the removing plate. By attaching this removing plate to a developer scatter preventing cover $8_1$ provided upstream of the hopper 5, the developer is prevented from dropping from the developer scatter preventing cover $8_1$. The developer scatter preventing cover $8_1$ is removably mounted to the hopper by means of a rail. The movement of the developer is generally the same as that in the embodiment of FIG. 2A, but the developer removed by the removing plate passes through the apertures 7 in the removing plate and is carried while again adhering to the surface of the developing sleeve for collection into the hopper 5 and is sufficiently stirred for mixing with the developer in the hopper, whereafter a layer of developer is newly formed on the developing sleeve so that it may be used for development.

Figure 4:
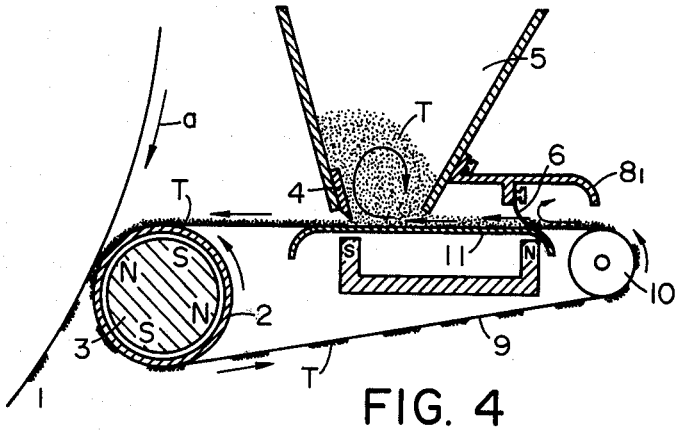

FIG. 4 shows still another embodiment of the present invention. In this embodiment, as the developer holding means, a belt 9 is used instead of a developing sleeve and magnetic developer is applied onto this belt, which is moved round. Development is effected with the belt 9, having magnetic developer applied thereto, being opposed to an electrostatic latent image bearing member 1. Designated by 2 is a sleeve having a magnet roll 3 therewithin and driving the belt 9. Denoted by 10 is a rotatable roller. The belt 9 is passed over the sleeve 2 and the roller 10 and is moved round. Designated by 11 is a back side supporting member of nonmagnetic material for positioning the belt 9 in place. Denoted by 4 is a doctor blade for controlling the thickness of the magnetic developer layer on the belt 9. One of the poles of a magnet is disposed adjacent to that portion of the back side of the belt 9 which is opposed to the tip end of the doctor blade, to thereby ensure the accuracy with which the thickness of the developer layer is controlled. A developer removing plate (a phosphor bronze plate) 6 having apertures at the end thereof is attached to a developer scatter preventing cover $8_1$ disposed upstream of a hopper 5 which is a device for supplying magnetic developer T, and the end of the developer removing plate is in contact with the belt 9. The end of the phosphor bronze plate 6 is in contact with the belt 9 in such a manner that said end is opposed to the direction in which the developer on the belt comes back, and the other pole of the magnet is disposed adjacent to that portion of the back side of the belt which is opposed to the apertures formed at the end of the removing plate 6. The magnet may be a permanent magnet or an electromagnet and the magnetic field reaching the apertures at the end of the removing plate 6 may be an alternating magnetic field. (This also holds true with the embodiments of FIGS. 2A and 3.) The developer scraped off by the end of the removing plate 6 slightly accumulates on the portion of contact with the developer removing plate, whereafter such developer passes through the apertures provided at the end of the removing plate 6 and into the hopper 5 to assume a substantially steady state.

As described above in detail, by the construction of the present invention, the developer after the developing action is once removed from the surface of the developing sleeve, whereafter it again adheres to the surface of the developing sleeve, and then is collected into the developer supplying hopper and well mixed with the fresh developer in the hopper and thereafter again forms a layer of developer on the developing sleeve, and such layer is used for development.

As the result of such construction and operation, even if the developing action is carried out for a long time, no thin layer of developer is formed on the surface of the developer holding means, so that a good developing performance can always be maintained. The developer layer used for the developing action is once removed and then a new developer layer is formed, and this leads to obtainment of very remarkable effects that no aggregation of the developer is created and that the history of development of the developer layer on the developer holding means is erased to prevent any ghost from being created in the next cycle of development. Also, there are the advantages that the replacement of the scraper is easy, that the removal of foreign materials such as paper powder and the like is easy and that the use of the scraper having openings readily permits the re-use of the once removed toner.

What has been referred to as the one-component developing method in the foregoing description is so referred to for the conventional mixed system of carrier particles and toner particles, and the mixture of toner particles and a charge control agent, a lubricant, an abrasive or the like is within the range of one-component development. In the foregoing embodiments, the latent image bearing member has been described with respect to an electrostatic latent image, but it is also applicable to magnetic latent images. In this latter case, magnetic field generating means which will disturb the magnetic latent image must not be disposed within the magnetic sleeve opposed to the magnetic latent image. Further, in the foregoing embodiments, the magnetic roll has been described as fixed and the developing sleeve has been described as movable, but the magnetic roll may be movable and the developing sleeve may be fixed and other various relative movements are applicable.

What we claim is:

1. A developing device comprising:

developer holding means disposed with a minute gap with respect to a latent image bearing member for moving developer in a predetermined direction to a development station;

developer supply means for supplying developer to the surface of said developer holding means;

a scatter preventing cover to prevent scattering of developer removably attached to said developer supply means for covering at least a portion of said holding means at a location spaced downstream from the development station and upstream of said developer supply means with respect to the direction of movement of the developer;

control means for controlling the thickness of a developer layer on said developer holding means, said control means being positioned downstream of said supply means and upstream from the development station; and a developer removing member attached to said cover and adapted to be in contact with the surface of said developer holding means to remove the developer on the surface of said developer holding means and to again impart the removed developer to the surface of said developer holding means at a position upstream of said developer supply means and downstream of the development station.

2. The developing device according to claim 1, wherein said developer removing member is in the form of a blade and the end edge thereof is in resilient contact with the surface of said developer holding means.

3. The developing device according to claim 1, wherein said developer holding means has a magnet roll and a relatively movable non-magnetic sleeve enclosing said roll, and said magnet roll has at least magnetic poles at the developing station and a position opposed to said developer layer thickness control means.

4. The developing device according to claim 1, wherein said developer layer thickness control means is in the form of a magnetic blade.

5. The developing device according to claim 1, wherein said developer supply means is a hopper for containing one-component magnetic toner therein.

6. The developing device according to claim 1, wherein said developer holding means is an endless belt.

7. A developing device comprising:

an endless developer holding means, disposed with a minute gap with respect to a latent image bearing member, for holding and moving developer in a predetermined direction to a development station;

developer supply means for supplying developer to the surface of said developer holding means;

a scatter preventing cover to prevent scattering of developer removably attached to said developer supply means for covering at least a portion of said holding means at a location spaced downstream from the development station and upstream of said developer supply means with respect to the direction of movement of the developer;

control means for controlling the thickness of a developer layer on said developer holding means, said control means being positioned downstream of said supply means and upstream of the development station; and a developer removing member attached to said cover and adapted to be in contact with the surface of said developer holding means to remove the developer on the surface of said developer holding means and to again impart the removed developer to the surface of said developer holding means at a position upstream of said developer supply means and downstream of the development station, said developer removing member having developer passage openings in the neighborhood of the portion thereof which is in contact with the surface of said developer holding means.

8. The developing device according to claim 7, wherein said developer removing member is attached in a counter direction with respect to the direction of movement of the developer layer on said developer holding means.

9. A developing device comprising:

an endless developer holding means for holding and moving developer in a predetermined direction to a development station disposed with a minute gap with respect to a latent image bearing member;

developer supply means for supplying developer to the surface of said developer holding means;

a scatter preventing cover to prevent scattering of developer removably attached to said developer supply means for covering at least a portion of said holding means at a location spaced downstream from the development station and upstream of said developer supply means with respect to the movement of the developer;

control means for controlling the thickness of a developer layer on said developer holding means, said control means being positioned downstream of said supply means and upstream of the development station;

a developer removing member attached to said cover and adapted to be in contact with the surface of said developer holding means to remove the developer on the surface of said developer holding means and to again impart the removed developer to the surface of said developer holding means at a position upstream of said supply means and downstream of the development station, said developer removing member having a developer passage openings in the neighborhood of the portion thereof which is in contact with the surface of said developer holding means; and a magnetic field generating portion providing adjacent to said developer passage openings.

10. A developing device in which triboelectrical charge is imparted to developer and the developer is provided to a surface to be developed to thereby effect development, said device comprising a developer holding member disposed with a minute gap with respect to a latent image bearing member for moving developer in a predetermined direction to a development station, a doctor blade for controlling the thickness of a developer layer on said holding member, a detachable scatter preventing cover, detachable from the body of the device, for covering at least a portion of the holding member at a location spaced upstream of a developer supply station and downstream of the development station from the latent image bearing member for preventing scattering of developer, and a member attached to said cover at a suitable position downstream of the development station and upstream of the developer supply station for removing the developer used in a prior development and remaining on said developer holding member.

11. A developing device in which triboelectric charge is imparted to developer by the friction between the developer and its carrying means and the developer is used for development, said device having:

a station for supplying the developer to the developer carrying means in each cycle of development;

a detachable scatter preventing cover, detachable from the body of the device, for covering at least a portion of the developer carrying means spaced upstream from said supply station with respect to the direction of movement of the developer to prevent scattering of developer;

a station for imparting the developer to a surface to be developed to thereby develop and surface, said station being located upstream of said scatter preventing cover; and a station disposed at a predetermined position during the time from after development until said supply of developer is effected, for removing from said developer carrying means substantially all of the developer remaining after having passed through said developing station, said developer being removed by a removing member attached to said cover.

* * * * *